US011491452B2

(12) United States Patent
Haughton et al.

(10) Patent No.: US 11,491,452 B2
(45) Date of Patent: Nov. 8, 2022

(54) FLUIDICALLY POWERED LINEAR MOTION MIXER

(71) Applicant: Enersave Fluid Mixers Inc., Oakville (CA)

(72) Inventors: Gary Haughton, Oakville (CA); Alesandro Rosada, Toronto (CA)

(73) Assignee: Enersave Fluid Mixers Inc., Oakville (CA)

( * ) Notice: Subject to any disclaimer, the term of this patent is extended or adjusted under 35 U.S.C. 154(b) by 566 days.

(21) Appl. No.: 16/466,474

(22) PCT Filed: Dec. 5, 2017

(86) PCT No.: PCT/CA2017/051466
§ 371 (c)(1),
(2) Date: Jun. 4, 2019

(87) PCT Pub. No.: WO2018/102916
PCT Pub. Date: Jun. 14, 2018

(65) Prior Publication Data

US 2020/0061560 A1 Feb. 27, 2020

Related U.S. Application Data

(60) Provisional application No. 62/430,120, filed on Dec. 5, 2016.

(51) Int. Cl.
*B01F 31/441* (2022.01)
*B01F 35/32* (2022.01)
(Continued)

(52) U.S. Cl.
CPC ..... *B01F 35/325* (2022.01); *B01F 31/441* (2022.01); *B01F 31/70* (2022.01); *B01F 35/32015* (2022.01); *B01F 35/71805* (2022.01)

(58) Field of Classification Search
CPC ..... B01F 11/0082; B01F 15/00467; B01F 31/441; B01F 35/324; B01F 35/325
(Continued)

(56) References Cited

U.S. PATENT DOCUMENTS 1,769,221 A * 7/1930 Howcott ..... D06F 15/00 68/124
1,846,664 A * 2/1932 Wilsey ..... D06F 15/00 68/122

(Continued)

*Primary Examiner* — David L Sorkin
(74) *Attorney, Agent, or Firm* — Ridout & Maybee LLP

(57) ABSTRACT

A reciprocating mixer for mixing liquids comprises a mixing shaft supporting a mixing head. A reciprocating drive assembly is connectable to the shaft and comprises a reciprocating fluidically powered actuator having a vertically reciprocating drive shaft coupled to the mixing shaft, a first fluidic input and a second fluidic input. A fluidic control valve is connected to the first and second fluidic inputs of the actuator. A fluidic pump has a fluidic output connected to the fluidic input of the control valve. A control unit has a communication interface connected to the communication port of the fluidic control valve and the control input the fluidic pump. In use, the fluidic pump and the fluidic control valve are operated by the control unit to provide for a downward motion cycle portion and an upward motion cycle portion that impart the vertically reciprocating movement to the mixing head.

20 Claims, 11 Drawing Sheets

(51) Int. Cl.
*B01F 31/00* (2022.01)
*B01F 35/71* (2022.01)

(58) Field of Classification Search
USPC ..... 366/332–335
See application file for complete search history.

(56) References Cited

U.S. PATENT DOCUMENTS

| | | | | | |
|---|---|---|---|---|---|
| 3,266,782 | A * | 8/1966 | Gatsis | B01F 11/0082 | 366/335 |
| 7,278,781 | B2 * | 10/2007 | Haughton | B01F 11/0082 | 366/316 |
| 7,399,112 | B2 * | 7/2008 | Haughton | B01F 11/0082 | 366/258 |
| 7,685,896 | B2 * | 3/2010 | Haughton | B01F 15/00915 | 74/44 |
| 9,162,195 | B2 * | 10/2015 | Haughton | B01F 11/0082 | |
| 2005/0174883 | A1 * | 8/2005 | Haughton | B01F 11/0091 | 366/332 |
| 2006/0221766 | A1 * | 10/2006 | Haughton | B01F 11/0091 | 366/332 |

* cited by examiner

FLUIDICALLY POWERED LINEAR MOTION MIXER

FIELD OF THE INVENTION

The present invention relates to mixers for mixing liquids, and more particularly to fluidically powered linear motion mixers for mixing liquids.

BACKGROUND AND SUMMARY OF THE INVENTION

The applicant herein is a pioneer in the use of linear motion mixers for the mixing of fluids in large scale vessels, and the like, to carry out industrial and commercial processes on a substantially continuous basis. Examples of such continuous processes include, in the mining field, froth separation and solvent extraction electrowinning, and, in the waste water treatment field, the bacterial digestion of sewage sludge in municipal waste water digesters. While not limited to use in these large scale mixing operations, the improved mixing characteristics, operational energy savings, and diminished maintenance costs achieved by substituting a single linear motion mixer for a plurality of prior art rotary style mixers in these large scale operations are particularly significant and self-evident.

Prior art linear motion mixers of the present inventor(s) are disclosed in, inter alia, WO 02/083280 A1, WO 2004/045753 A1 and WO 2004/098762 A1, U.S. Pat. Nos. 6,830,369, 7,029,166, 7,278,781, 7,364,351, 7,399,112, 7,685,896, and 9,162,195, all of which references are hereby incorporated by reference. The reciprocating drive assemblies commonly disclosed in all of these prior art references are so-called "Scotch yoke mechanisms", wherein a crank assembly on a rotating flywheel reciprocates in a horizontal race of the yoke assembly, thereby causing the yoke member to slide up and down relative to one or more vertically oriented linear track slides/guide rails. A vertically directed mixing shaft having a mixing head rigidly attached adjacent its bottom end is connected adjacent its top end to the yoke member by means of a shaft mounting assembly, thereby to impart reciprocating motion of the yoke member to the driveshaft upon rotation of the flywheel.

While the aforesaid prior art documents demonstrate, disclose and teach the advantages of using a Scotch yoke drive assembly for converting rotary motion of a flywheel into reciprocating motion of a mixing shaft and attached mixing head, the inventors have, as a first adaptor of this technology to linear motion mixers, become aware of the need for further improvements in this area of technology, and have become aware that through the present invention such further improvements are significant and can overcome various problems with the prior art and can meet several needs that are apparent in the related art. This need was largely for the reasons of reduced capital costs, reduced operational costs, reduced cost of on-site installation, reduced maintenance scheduling, reduced maintenance costs, improved operating reliability, improved mixing performance, and also reduced weight, since many linear mixers are retrofitted onto the covers of vessels that were not originally intended or designed to bear significant central weight loading.

To this end, it is an object of the present invention to provide an improved linear motion mixer for mixing liquids that provides for reduced costs of production.

It is also an object of the present invention to provide an improved linear motion mixer for mixing liquids that provides for operational cost effectiveness.

It is also an object of the present invention to provide an improved linear motion mixer for mixing liquids that provides for reduced cost of on-site installation.

It is also an object of the present invention to provide an improved linear motion mixer for mixing liquids that provides for reduced maintenance and maintenance costs.

It is also an object of the present invention to provide an improved linear motion mixer for mixing liquids that provides for improved maintenance efficiencies.

It is also an object of the present invention to provide an improved linear motion mixer for mixing liquids that provides for improved operating reliability and performance.

It is also an object of the present invention to provide an improved linear motion mixer for mixing liquids and improved reciprocating drive assembly for linear motion mixers for mixing liquids that provide for improved operating performance, reliability and costs, especially over the long term.

It is also an object of the present invention to provide an improved linear motion mixer for mixing liquids that provides for an overall reduction in weight of the mixer as compared with prior art reciprocating linear motion mixers having the same mixing capacity, thereby facilitating it being retro-fitted atop the central area of the cover portion of large mixing vessels that may not have originally been designed to bear the weight of said prior art reciprocating linear motion mixers.

It is a further object of the present invention to provide, according to one of its aspects, a fluidically powered linear motion mixer that accommodates the re-positioning of a plurality of its components away from the central area of the cover portion of the mixing vessel, thereby permitting a significant portion of the overall weight of the improved linear motion mixing device to be located outside of this relatively weaker center area of the cover portion of the mixing vessel.

It is a further object of the present invention to provide, according to one of its aspects, a fluidically powered linear motion mixer that accommodates the re-positioning of a plurality of its components to a position beyond the outer peripheral wall(s) of the mixing vessel, which location may be, for example, in a separate enclosed structure remote from the mixing vessel, thereby permitting secure and convenient operational access to said plurality of components of the mixer.

It is also an object of the present invention to provide an improved reciprocating drive assembly for linear motion mixers liquids that exhibits significantly reduced manufacturing costs and complexity by reducing the need for complex parts machined to close tolerances.

It is a further object of the present invention to provide an improved reciprocating drive assembly for linear motion mixers which drive assembly is easier to install, to assemble, and to maintain in the field due to the use of components and assemblies having much wider manufacturing and assembly tolerances than previously available for use in prior art mechanisms suitable for this purpose.

It is a further object of the present invention to provide an improved reciprocating drive assembly for linear motion mixers which exhibits reduced energy consumption as compared to the mechanical losses inherent in prior art reciprocating drive assemblies used for this purpose.

It is still a further object of the present invention to provide an improved linear motion mixer for mixing liquids and an improved reciprocating drive assembly for mixers for mixing liquids, which mixer and drive assembly significantly reduce maintenance requirements by substantially eliminating the need for continuous lubrication of the moving components of the drive assembly for reliable and energy efficient operation.

It is yet a further object of the present invention to provide an improved linear motion mixer for mixing liquids and improved reciprocating drive assembly for linear motion mixers for mixing liquids, which mixer and drive assembly ameliorate energy loss and maintenance issues caused by uneven wear, binding and/or jamming between the linear bearing slides and the yoke assembly of prior art Scotch yoke mechanisms due to unbalanced lateral loading of the yoke assembly by the mixing shaft.

There is thus disclosed according to one aspect of the present invention a fluidically powered linear motion mixer for mixing liquids. The mixer comprises a mixing shaft having an upper end and a lower end and defining a longitudinal axis extending therebetween, with the mixing shaft supporting a mixing head adjacent its lower end for immersion in the liquids. A reciprocating drive assembly is connectable to the mixing shaft adjacent its upper end for imparting vertically reciprocating movement to the mixing head in substantially parallel relation to the longitudinal axis. The drive assembly comprises a reciprocating fluidically powered actuator having a vertically reciprocating drive shaft coupled in driving relation to the mixing shaft and oriented such that the drive shaft moves generally vertically between a maximum raised position and a minimum lowered position. The actuator has a first fluidic input and a second fluidic input. Increased fluid pressure at the first fluidic input causes the drive shaft to move vertically downwardly, and increased fluid pressure at the second fluidic input causes the drive shaft to move vertically upwardly. A fluidic control valve has a fluidic input, a first fluidic output, and a second fluidic output, and a communication port. The first fluidic output is connected in fluid communication to the first fluidic input of the reciprocating fluidically powered actuator, and the second fluidic output is connected in fluid communication to the second fluidic input of the reciprocating fluidically powered actuator. A fluidic pump has a fluidic output and a control input, and is connected at the fluidic output in fluid communication to the fluidic input of the control valve, such that the fluidic pump provides fluid under pressure to the reciprocating fluidically powered actuator via the fluidic control valve. A control unit has a communication interface connected to the communication port of the fluidic control valve and to the control input of the fluidic pump for permitting operation of the mixer by a user. In use, the fluidic pump and the fluidic control valve operate under the control of the control unit to provide for: (a) a downward motion cycle portion having a greater fluid pressure at the first fluidic output thereof, and at the first fluidic input of the reciprocating fluidically powered actuator, and a lesser fluid pressure at the second fluidic output thereof and at the second fluidic input of the reciprocating fluidically powered actuator, so as to cause corresponding downward displacement of the drive shaft of the reciprocating fluidically powered actuator; and (b) an upward motion cycle portion having a lesser fluid pressure at the first fluidic output thereof and at the first fluidic input of the reciprocating fluidically powered actuator, and a greater fluid pressure at the second fluidic output thereof and at the second fluidic input of the reciprocating fluidically powered actuator, so as to cause corresponding upward displacement of the drive shaft of the reciprocating fluidically powered actuator, to thereby impart the vertically reciprocating movement to the mixing head.

There is also disclosed according to another aspect of the present invention a fluidically powered linear motion mixer for mixing liquids retained within a vessel having a cover. The mixer comprises a mixing shaft supporting a mixing head and a reciprocating drive assembly. The reciprocating drive assembly has a reciprocating fluidically powered actuator, which actuator has a vertically reciprocating drive shaft coupled in driving relation to the mixing shaft. The mixer further comprises a fluidic control valve and a fluidic pump operatively connected in fluid communication to the control valve. A control unit is operatively connected to the fluidic control valve and to the fluidic pump for permitting reciprocation of the mixer by a user. According to a first embodiment of this aspect of the invention, the reciprocating drive assembly, the fluidic control valve, the fluidic pump and the control unit are all disposed within the central area of the cover portion. According to a second embodiment of this aspect of the invention, the fluidic control valve, the fluidic pump and the control unit are all disposed outside the central area of the cover portion so as to reduce the weight of the components of the fluidically powered linear motion mixer supported by said central area of the cover portion.

The above and other objects, advantages, features and characteristics of the present invention, as well as methods of operation and functions of the related elements of the structure, and the combination of parts and economies of manufacture, will become more apparent upon consideration of the following detailed description and the appended claims with reference to the accompanying drawings, the latter of which is briefly described hereinbelow.

BRIEF DESCRIPTION OF THE DRAWINGS

The novel features which are believed to be characteristic of the present invention, as to its structure, organization, use and method of operation, together with further objectives and advantages thereof, will be better understood from the following drawings in which a presently preferred embodiment of the invention will now be illustrated by way of example. It is expressly understood, however, that the drawings are for the purpose of illustration and description only, and are not intended as a definition of the limits of the invention. In the accompanying drawings.

DETAILED DESCRIPTION OF THE EXEMPLARY EMBODIMENTS

Figure 6:
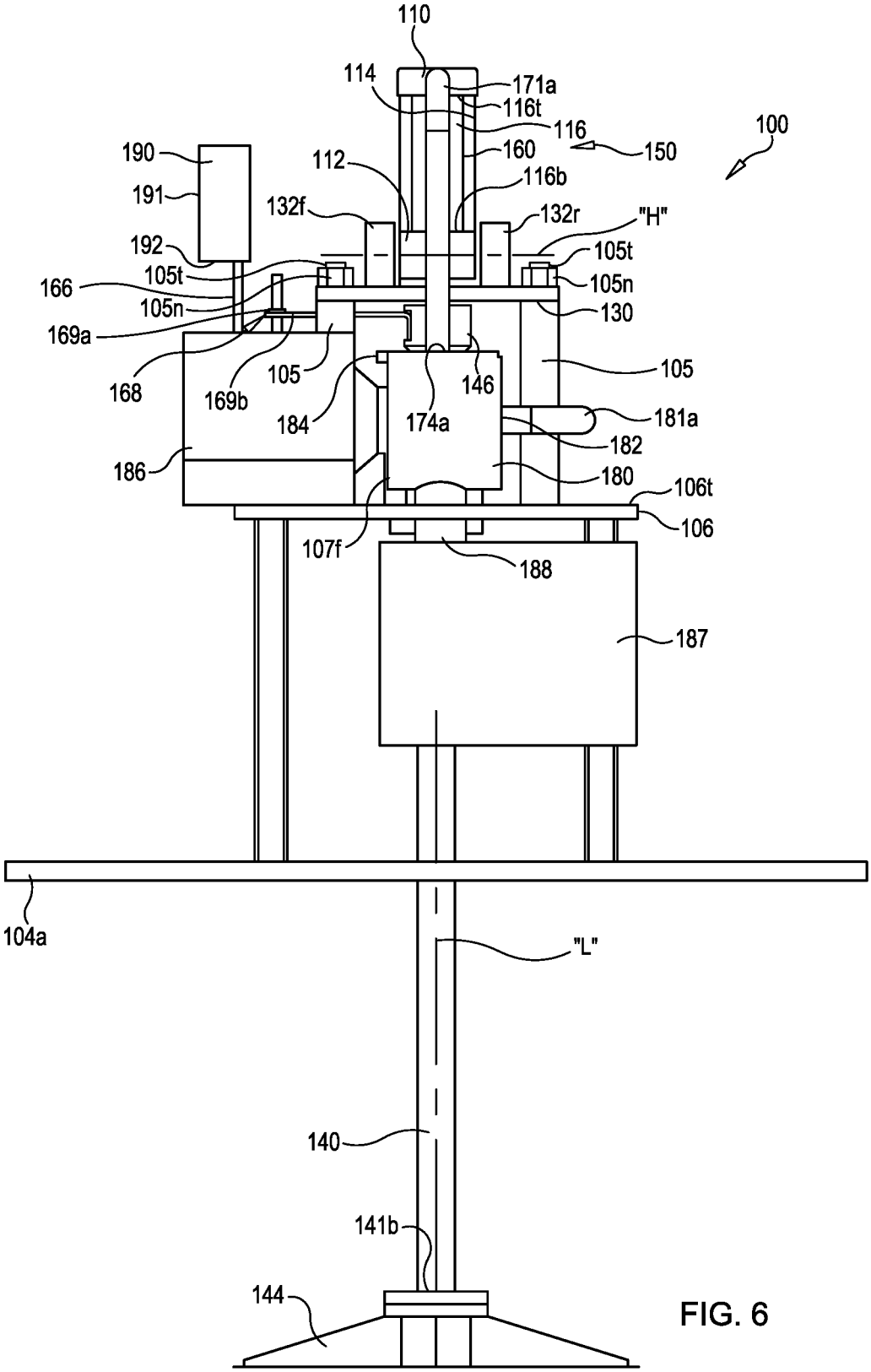
FIG. 6 is a right side elevational view of the embodiment of FIG. 2.
Figure 7:
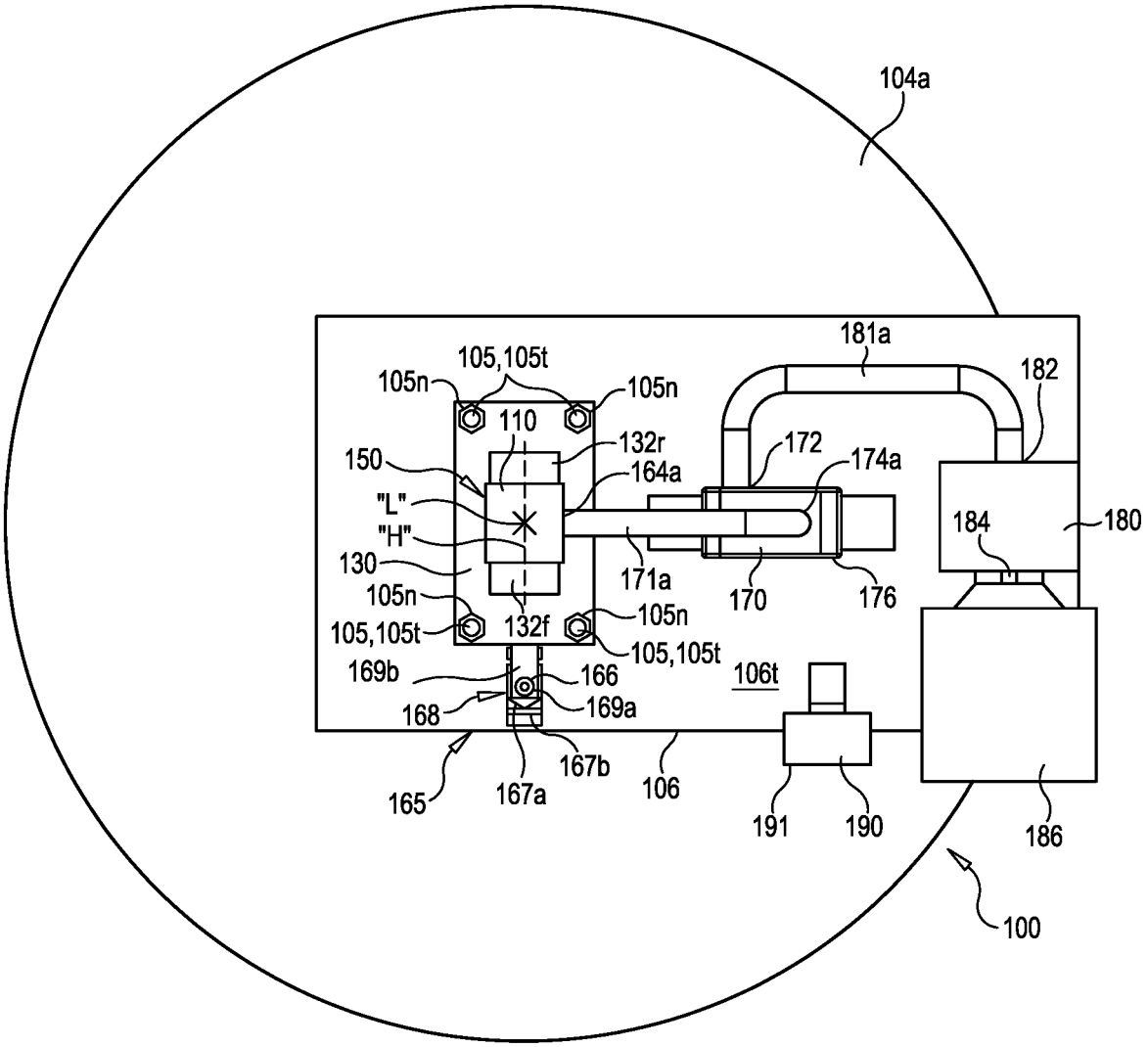
FIG. 7 is a top plan view of the embodiment of FIG. 2.
Figure 8:
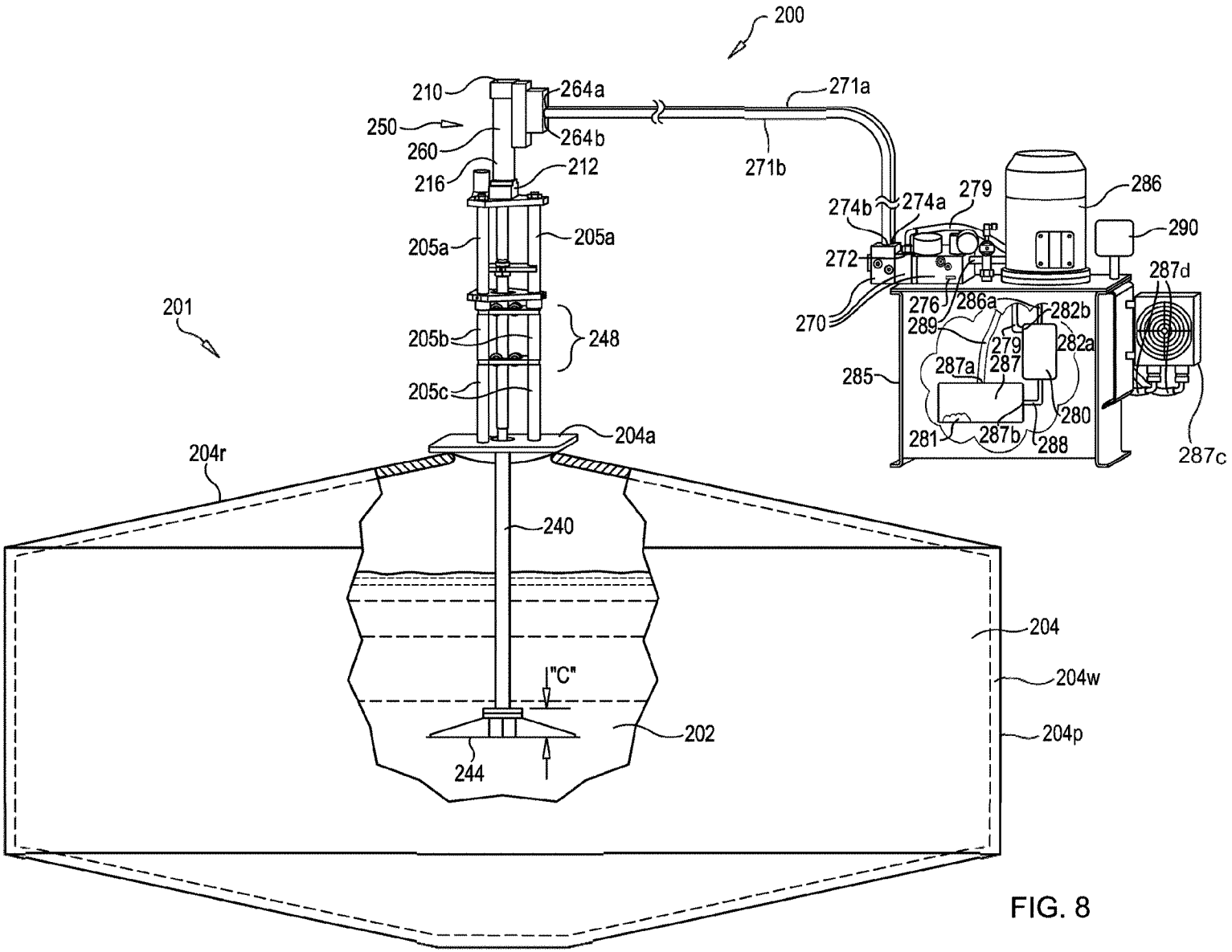
FIG. 8 is a front elevational view of an improved fluidically powered linear motion mixer for mixing liquids according to a second exemplary embodiment of the present invention, shown installed atop a vessel (in this case a municipal sewage digester, shown partially cut away), for mixing fluids within the vessel; and, FIG. 9 is a front isometric view, in isolation, of the second embodiment of FIG. 8.
Figure 9:
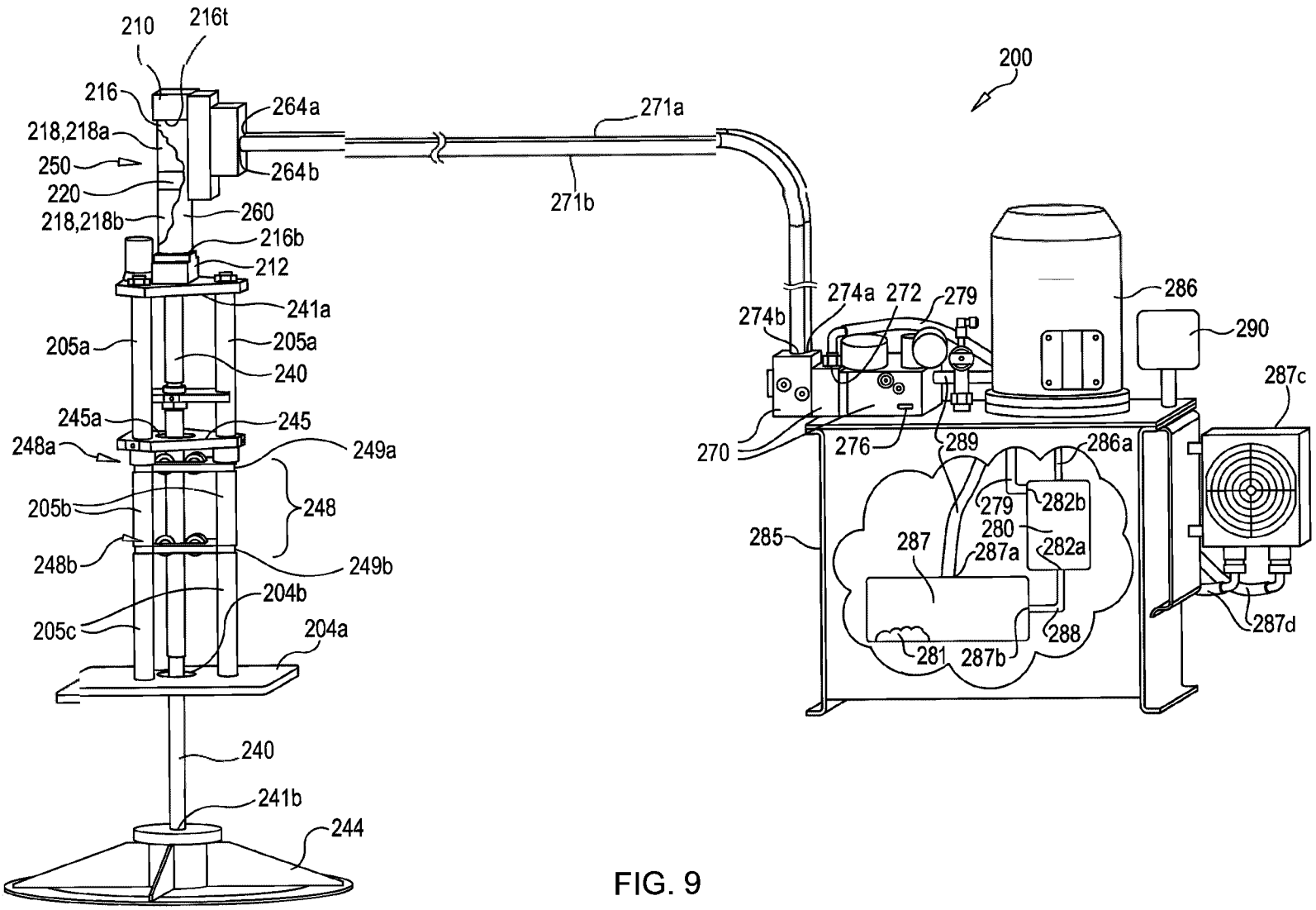

Referring to FIGS. 1 through 9 of the drawings, it will be noted that FIGS. 1 through 7 illustrate a first exemplary embodiment of an improved liner motion mixer according to the present invention, and FIGS. 8 and 9 illustrate a second embodiment of improved linear motion mixer according to the present invention.

Figure 1:
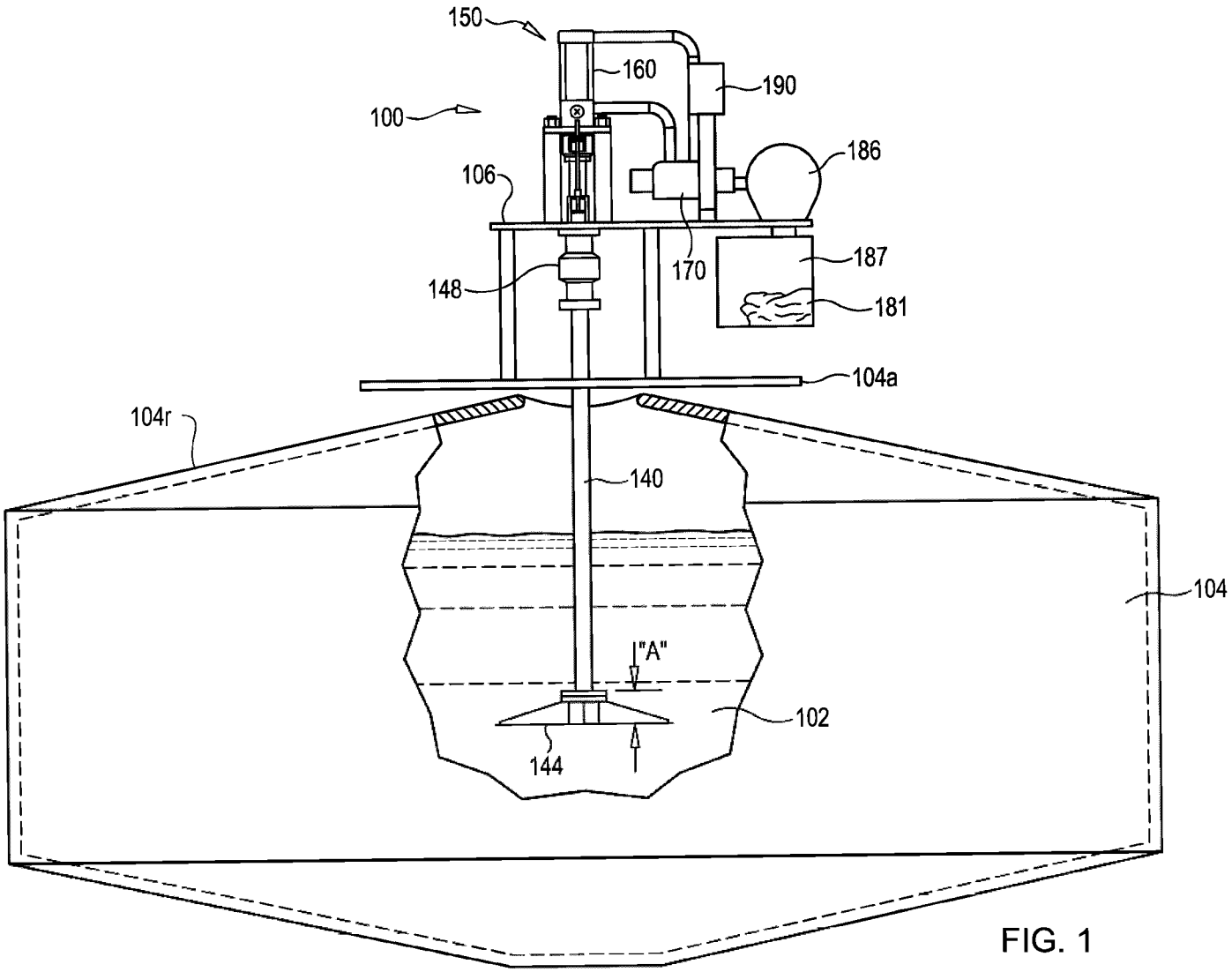
FIG. 1 is a front elevational view of an improved fluidically powered linear motion mixer for mixing liquids according to a first exemplary embodiment of the present invention shown centrally installed atop the cover portion of a vessel (in this case a municipal sewage digester, shown partially cut away), for mixing fluids within the vessel.
Figure 2:
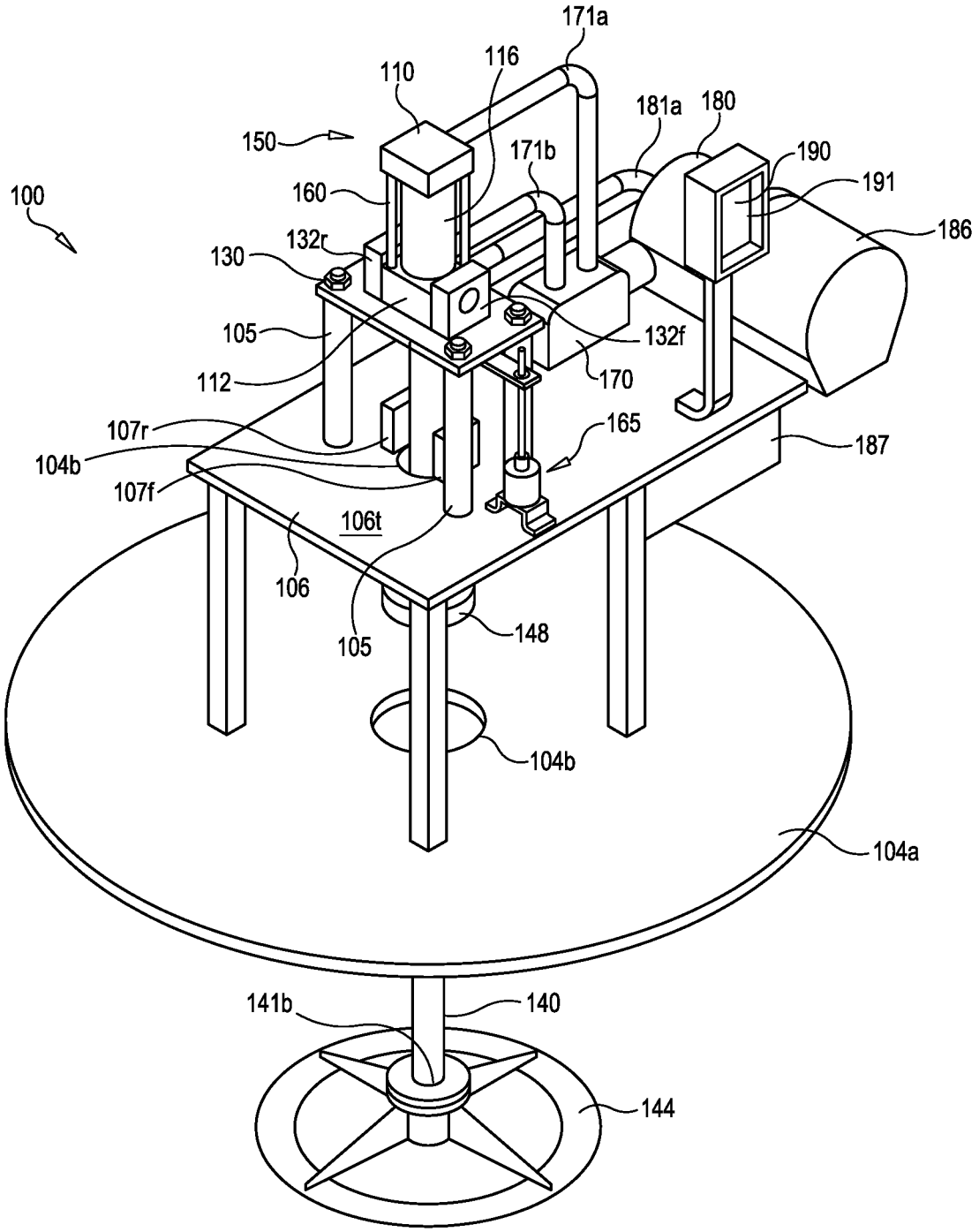
FIG. 2 is a front isometric view, in isolation, of the embodiment of mixer shown in FIG. 1.

Reference will now be made to FIGS. 1 through 7, which show the first exemplary embodiment linear motion mixer 100 according to the present invention. With particular reference to FIG. 1, there will be seen a fluidically powered linear motion mixer 100 for mixing liquids 102 within a vessel 104. The fluidically powered linear motion mixer 100 is shown installed in its entirety atop the central area of the cover portion 104*r* of vessel 104 (in this case a municipal sewage digester, shown partially cut away), supported on a base plate 104*a* that is secured to the top portion 104*r* by any suitable means. The cover portion 104*r* could partially cover the top of the vessel, or fully cover the vessel 104, as shown in the figures. The fluidically powered linear motion mixer 100 can be used in conjunction with any other type of suitable vessel, either opened or closed at its top end, and can also be used in the installations where there is not a vessel present, such as in conjunction with natural body of water or an artificial entrapment of water or other liquids.

The first exemplary embodiment according to the present invention discloses a fluidically powered linear motion mixer 100 for mixing liquids 102 typically retained within the vessel 104. In brief, the fluidically powered linear motion mixer 100 comprises a mixing shaft 140 supporting a mixing head 144, and a reciprocating drive assembly, as indicated by the general reference numeral 150, which drive assembly 150 comprises a reciprocating fluidically powered actuator 160, a fluidic control valve 170, a fluidic pump 180, and a control unit 190.

Figure 3A:
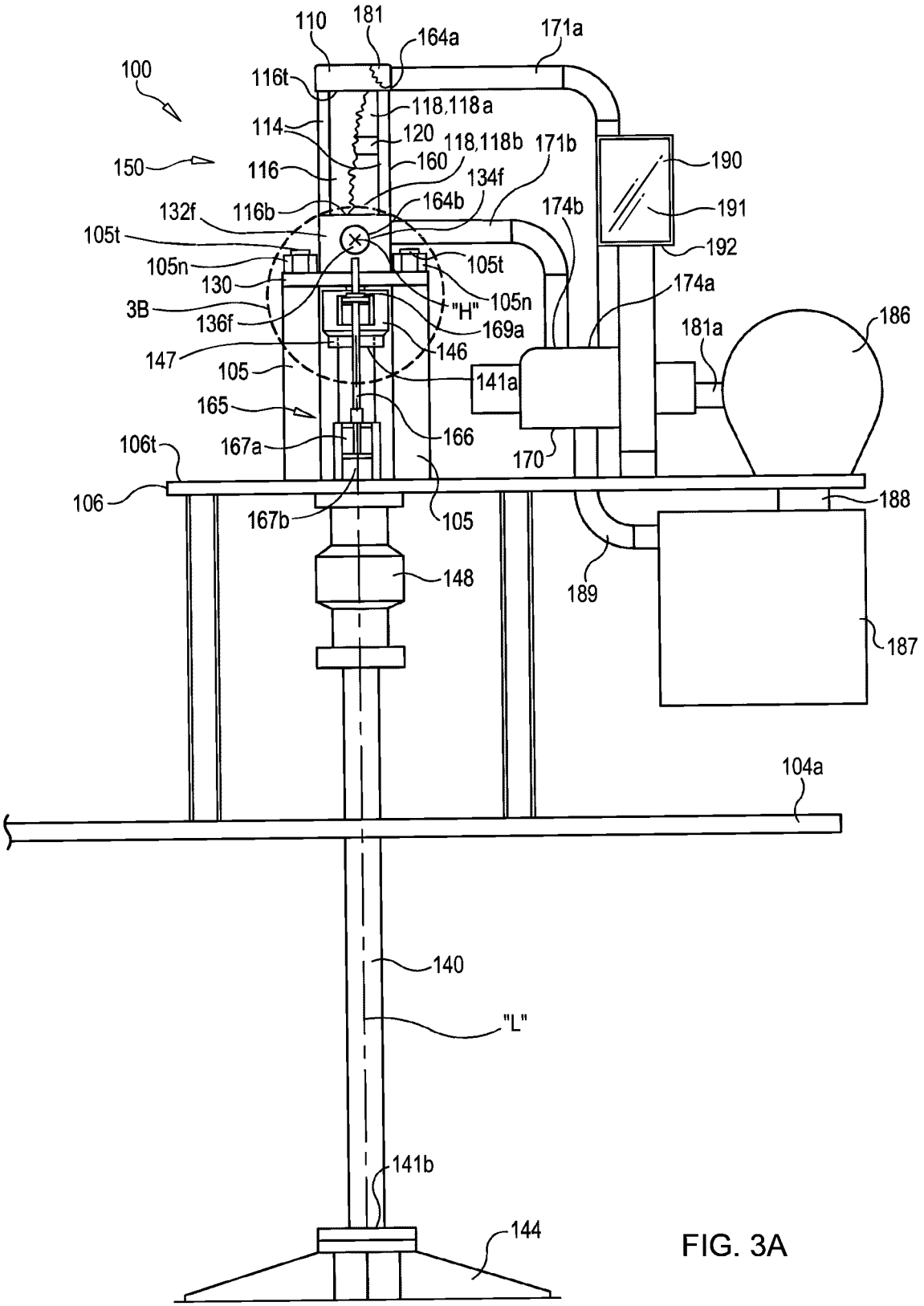
FIG. 3A is a front elevational view of the embodiment of FIG. 2.
Figure 3B:
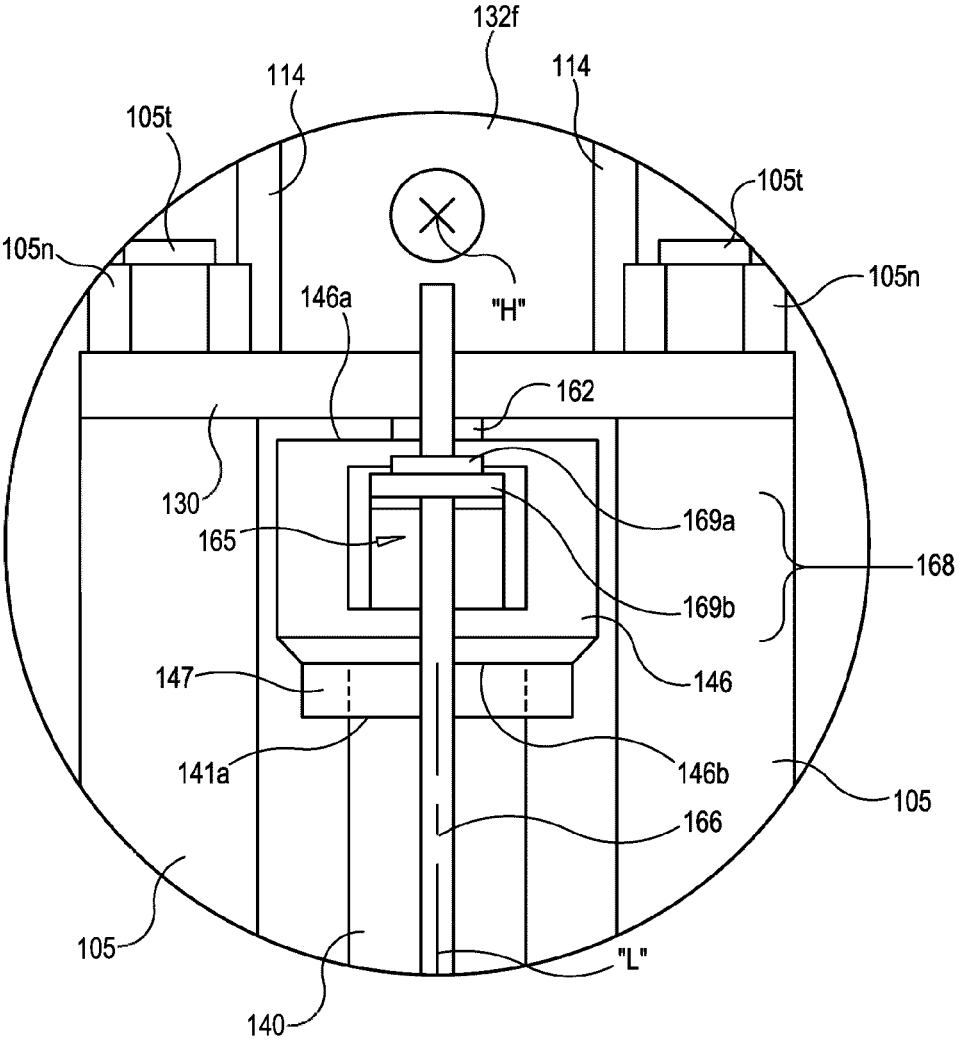
FIG. 3B is an enlarged front elevational view of the encircled area 3B of FIG. 3A.
Figure 5A:
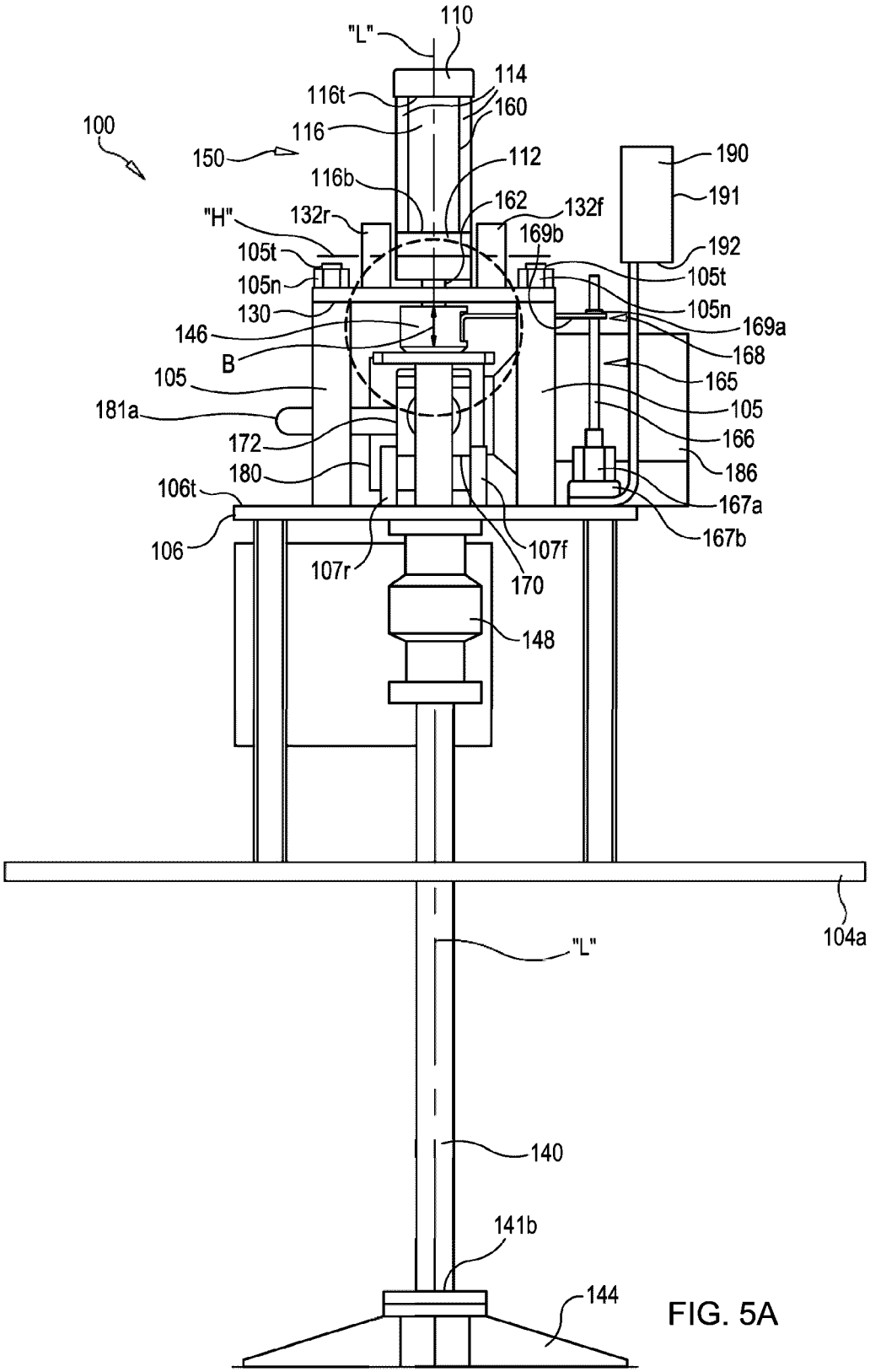
FIG. 5A is a left side elevational view of the embodiment of FIG. 2.
Figure 5B:
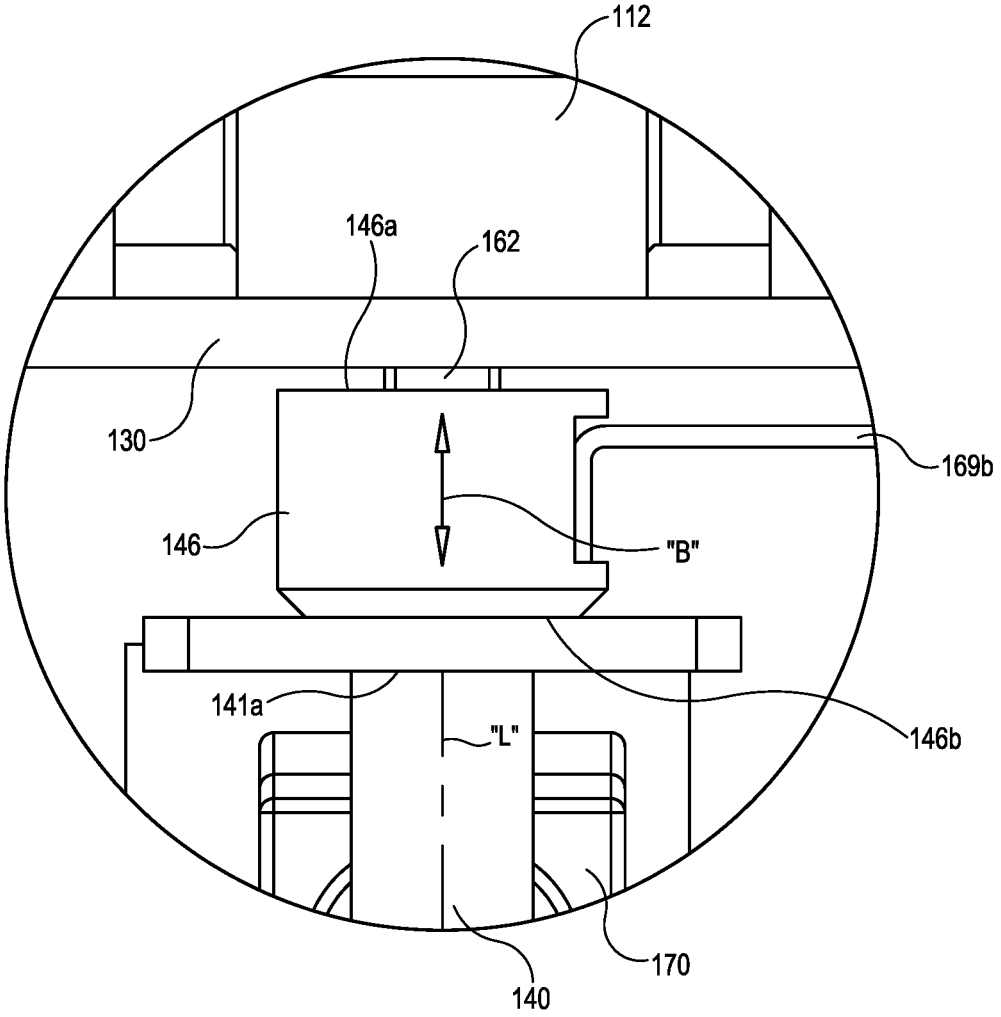
FIG. 5B is an enlarged front elevational view of the encircled area 5B of FIG. 5A.

More specifically, and as can readily be seen in the figures, the reciprocating fluidically powered actuator 160 comprises a downwardly extending drive shaft 162 (as best seen in FIGS. 3B and 5B) that is operatively connected at its lower end to a cylinder rod end alignment coupler 146 as will be discussed in greater detail subsequently. The reciprocating fluidically powered actuator 160 also has an upper frame block 110 and a lower frame block 112 interconnected by four vertical frame posts 114 and a cylindrical outer housing 116 having a top end 116*t* and a bottom end 116*b*, and that defines a substantially hollow interior 118 and that houses a vertically movable piston 120. The lower frame block 112 is mounted on a horizontal mounting plate 130 via a front mounting block 132*f* and a rear mounting block 132*r*. The front mounting block 132*f* has a circular aperture 134*f* therein for receiving a cooperating spindle 136*f* that is securely attached to the lower frame block 112. Similarly, the rear mounting block 132*r* has a circular aperture 134*r* therein for receiving a cooperating spindle 136*r* that is securely attached to the lower frame block 112. Via this described mounting assembly, the reciprocating fluidically powered actuator 160 is mounted for small arcuate pivotal movement about the horizontal axis "H" (see FIG. 6) to provide for small changes in the horizontal position of the mixing head 144 and corresponding small changes in the angular orientation of the mixing shaft 140.

An upper chamber 118*a* of the substantially hollow interior 118 is disposed immediately above the piston 120. Similarly, a lower chamber 118*b* of the substantially hollow interior 118 is disposed immediately below the piston 120 (see FIG. 4). When the upper chamber 118*a* of the substantially hollow interior 118 is at a greater pressure than the lower chamber 118*b* of the substantially hollow interior 118, the vertically movable piston 120 is pushed downwardly to either decelerate the upward motion of the piston 120 or to accelerate the downward motion of the vertically movable piston 120, depending on its motion and/or position at the time. Similarly, when the lower chamber 118*b* of the substantially hollow interior 118 is at a greater pressure than the upper chamber 118*a* of the substantially hollow interior 118, the vertically movable piston 120 is pushed upwardly to either decelerate the downward motion of the piston 120 or to accelerate the upward motion of the vertically movable piston 120, depending on its motion and/or position at the time.

The fluidically powered linear motion mixer 100 further preferably comprises a plurality (for example, four) vertically oriented legs 105 for mounting the fluidically powered linear motion mixer 100 on a mounting table 106 in vertically spaced relation above the top surface 106*t* of the mounting table 106. The mounting plate 130 is secured to the top ends of the four vertically oriented legs 105 by means of cooperating nuts 105*n* threadibly engaged on upwardly projecting threaded post portions 105*t* of the four vertically oriented legs 105. The reciprocating fluidically powered actuator 160 is thereby preferably mounted in removable and replaceable relation on the mounting table 106. The mounting table 106 is used to secure the fluidically powered linear motion mixer 100 to the base plate 104*a* situated atop the vessel 104.

Further, the fluidically powered linear motion mixer 100 comprises the mixing shaft 140 that has an upper end 141*a* and a lower end 141*b* and defines a longitudinal axis "L" extending between the upper end 141*a* and the lower end 141*b*. As can be readily seen in FIG. 1, the mixing shaft 140 supports the mixing head 144 adjacent its lower end 141*b* for immersion in the liquid 104 to be mixed in the vessel 104. The fluidically powered linear motion mixer 100 according to the present invention can be used with any type of a suitable vessel 104. Typically, the vessel 104 would be a large scale vessel used to carry out industrial and commercial processes on a substantially continuous basis. Examples of such continuous processes include, in the mining field, froth separation and solvent extraction electrowinning, and, in the waste water treatment field, the bacterial digestion of sewage sludge in municipal waste water digesters. While not limited to use in these large scale mixing operations, the improved mixing characteristics, operational energy savings, and diminished maintenance costs achieved by using a fluidically powered linear motion mixer 100 in these large scale operations are more significant and self-evident.

The reciprocating drive assembly 150 is connectable to the mixing shaft 140 adjacent its upper end 141*a* for imparting vertically reciprocating movement to the mixing head 144 in substantially parallel relation to the longitudinal axis "L".

The drive shaft 162 of the reciprocating fluidically powered actuator 160 of the reciprocating drive assembly 150 is connectable to the mixing shaft 140, preferably but not essentially, in a releasable manner by means of the cylinder rod end alignment coupler 146 (hereinafter, "CREAC") that has an upper end 146*a* and a lower end 146*b* (as best seen in FIGS. 3B and 5B). More specifically, the drive shaft 162 is coupled to the upper end 146*a* of a cylinder rod end alignment coupler 146 (hereinafter, "CREAC"). The CREAC is attached adjacent its lower end 146*b* to the upper end 141*a* of the mixing shaft 140. The CREAC 146 preferably has its lower end 146*b* held fast by a swage plug 147 (see especially FIG. 3B) inserted into and held fast by the upper end the upper end 141*a* of the mixing shaft 140. With such an arrangement, the lower end 146*b* of the CREAC 146 is free to rotate about a vertical axis relative to its upper end 146*a*, with the result that any tortional loading of the lower end 146*b* of the CREAC 146 that may be caused by vertical reciprocation of the mixing head 144 through the liquid 102 during operation of the linear motion linear motion mixer 100 is not transmitted to the upper end 146*a* of the CREAC 146, and hence on to the upstream components of the reciprocating drive assembly 150 of the linear motion linear motion mixer 100, with potential damaging effects to such upstream components.

A suitable form of CREAC 146 is available from Magnaloy Coupling Company, a division of Douville Johnston Corporation, of Alpina, Mich., USA. Model M Series accommodates, in addition to the rotational freedom mentioned in the previous paragraph, 10 degrees of spherical misalignment and ⅛ inch of lateral misalignment of the mixing shaft 84; Model R Series accommodates 7.5 degrees of spherical misalignment and ⅛ inch of lateral misalignment. The CREAC 146 shown in the Figures is a Magnaloy™ M050-12412 cylinder rod end alignment coupler.

The mixing shaft 140 also extends through a linear bearing assembly 148 that is secured to the mounting table 106 and also through an aperture 104*b* (see FIG. 2) in the base plate 104*a* to extend vertically downward therefrom to the mixing head 144. The linear bearing assembly 148 permits stable vertical bi-directional sliding of the mixing shaft 140, as indicated by opposed arrows "A" in FIG. 1, in conjunction with the drive shaft 162 (as best seen in FIGS. 3B and 5B) as the drive shaft 162 moves generally vertically between its maximum raised position and its minimum lowered position, as indicated by double ended arrow "B" in FIG. 5B.

As can be readily seen in the Figures, the drive assembly 150 comprises the reciprocating fluidically powered actuator 160 having the vertically reciprocating drive shaft 162 coupled in driving relation to the mixing shaft 140 and oriented such that the drive shaft 162 moves generally vertically between a maximum raised position and a minimum lowered position. The reciprocating fluidically powered actuator 160 is a linear motion reciprocating fluidically powered actuator 160. More specifically, the reciprocating fluidically powered actuator 160 comprises the cylindrical outer housing 116 and the piston 120 that moves vertically in reciprocating manner along the longitudinal axis "L", and may be a commercially available hydraulic drive cylinder, or may be custom built for a specific mixing application.

The reciprocating fluidically powered actuator 160 also comprises a first fluidic input 164*a* disposed adjacent the top end 116*t* of the cylindrical housing 116 and a second fluidic input 164*b* disposed adjacent the bottom end 116*b* of the cylindrical housing 116. Increased fluid pressure at the first fluidic input 164*a* (compared to lesser fluid pressure at the second fluidic input 164*b*) causes the drive shaft 162 to move vertically downwardly (as seen in the Figures) and increased fluid pressure at the second fluidic input 164*b* (compared to lesser fluid pressure at the first fluidic input 164*a*) causes the drive shaft 162 to move vertically upwardly (as seen in the Figures), as will be discussed in greater detail subsequently.

The fluidically powered linear motion mixer 100 further comprises a plurality of stop members, specifically, a front bottom stop member 107*f* and a rear bottom stop member 107*r* (as best seen in FIG. 5A). The front bottom stop member 107*f* and the rear bottom stop member 107*r* are secured to the mounting table 106 by suitable threaded fasteners (not shown) or any other suitable fastening means, and are disposed under the reciprocating fluidically powered actuator 160 for providing a lower vertical stop position for the vertically reciprocating drive shaft 162 of the fluidically powered actuator. Similarly, one or more top stop members (not shown) can be can be disposed above the reciprocating fluidically powered actuator 160 for providing an upper vertical stop position for the vertically reciprocating drive shaft 162 of the fluidically powered actuator 160.

It should also be noted that the inventors have discovered that while it is possible that the present invention could be either hydraulically powered or pneumatically powered, that the use of hydraulic power is preferred for most heavy-duty industrial applications. Accordingly, the exemplary embodiment in the specification shall be more specifically set forth and described hereinafter in relation to a hydraulically powered mixer for the sake of ease of explanation and maximum relevancy to the more commercially important embodiments.

In the first exemplary embodiment illustrated in FIGS. 1-7, the reciprocating fluidically powered actuator 160 comprises a hydraulically-powered actuator 160, the first fluidic input 164*a* comprises a first hydraulic input 164*a*, the second fluidic input 164*b* comprises a second hydraulic input 164*b*. Increased hydraulic pressure at the first hydraulic input 164*a* causes the drive shaft 162 to move vertically downwardly and increased hydraulic pressure at the second hydraulic input 164*b* causes the drive shaft 162 to move vertically upwardly.

A fluidic control valve 170 has a fluidic input 172, a first fluidic output 174*a*, and a second fluidic output 174*b*, and a communication port 176 (see FIG. 7). The first fluidic output 174*a* is connected in fluid communication to the first fluidic input 164*a* of the reciprocating fluidically powered actuator 160 by conduit 171*a* and the second fluidic output 174*b* is connected in fluid communication to the second fluidic input 164*b* of the reciprocating fluidically powered actuator 160 by conduit 171*b*. More specifically, the fluidic control valve 170 comprises a hydraulic control valve 170, the fluidic input 172 comprises a hydraulic input 172, the first fluidic output 174*a* comprises a first hydraulic output 174*a*, and the second fluidic output 174*b* comprises a second hydraulic output 174*b*. The first hydraulic output 174*a* is connected in fluid communication with the first hydraulic input 164*a* of the reciprocating hydraulically-powered actuator 160 by conduit 171*a* and the second hydraulic output 174*b* is connected in fluid communication with the second hydraulic input 164*b* of the reciprocating hydraulically-powered actuator 160 by conduit 171*b*. The communication port 176 receives control signals from the control unit 190 to control the action of the fluidic control valve 170, and therefore the action of the reciprocating fluidically powered actuator 160, as will be discussed in greater detail subsequently.

The fluidic pump 180 has a fluidic output 182 and a control input 184 (see FIGS. 6 and 7). The fluidic pump 180 is connected at the fluidic output 182 in fluid communication to the fluidic input 172 of the control valve 170 by conduit 181*a* such that the fluidic pump 180 provides fluid flow to the reciprocating fluidically powered actuator 160 via the fluidic control valve 170. More specifically, the fluidic pump 180 comprises a hydraulic pump 180 and the fluidic output 182 comprises a hydraulic output 182. The hydraulic pump 180 is connected at the hydraulic output 182 in fluid communication to the hydraulic input 172 of the hydraulic control valve 170 such that the hydraulic pump 180 provides hydraulic fluid 181 to the reciprocating hydraulically-powered actuator 160 via the hydraulic control valve 170. The control input 184 receives control signals from the control unit 190 to control the speed of the hydraulic pump 180, and therefore the rate at which hydraulic fluid 181 is provided from the hydraulic pump 180.

Figure 4:
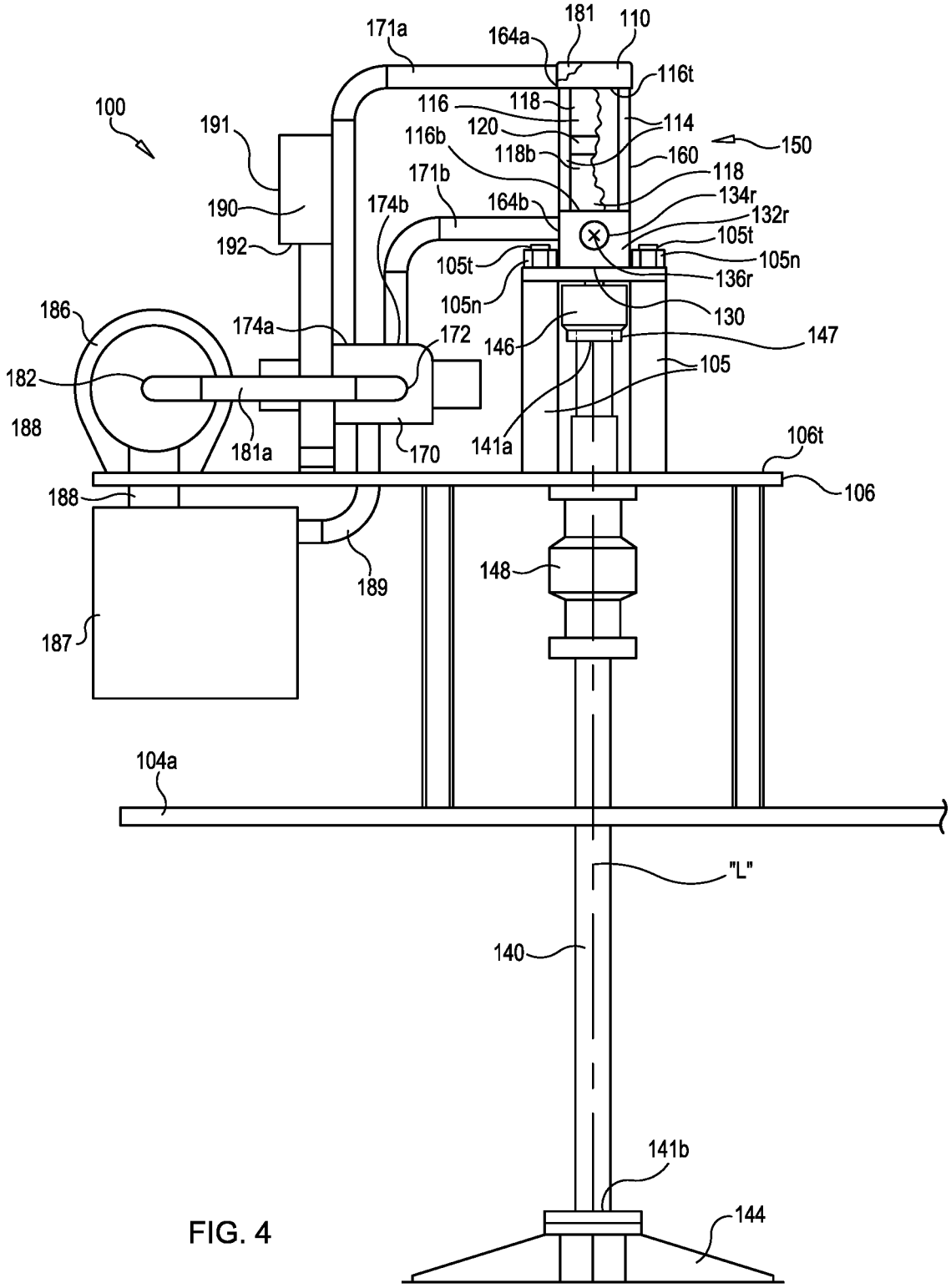
FIG. 4 is a rear elevational view of the embodiment of FIG. 2.

The hydraulic pump 180 is powered by an electric motor 186 and draws its hydraulic fluid 181 from a reservoir 187 mounted immediately below via a conduit 188. The reservoir 187 is fed from the hydraulic valve 170 through a return conduit 189 (as best seen in FIGS. 3A and 4) to thereby form a closed loop hydraulic system.

The control unit 190 has a communication interface 192 connected to the communication port 172 of the fluidic control valve 170 and the control input 184 (as best seen in FIGS. 6 and 7) the fluidic pump 180 for permitting operation of the fluidically powered linear motion mixer 100 by a user. More specifically, in the preferred embodiment illustrated, the control unit 190 comprises a digital electronic control unit 190 and the communication interface 192 of the digital electronic control unit 190 comprises a data interface 192 and the communication port 172 of the hydraulic control valve 170 comprises an electronic communication port 172.

The digital electronic control unit 190 also has a user interface 191 for permitting control of the fluidically powered linear motion mixer 100 by a user. Any suitable type of user interface may be used, such as a numeric keypad, an alphanumeric keypad, a touchscreen, rotary controls such as a rotary controlled optical encoder or a rheostat or the like, and so on. For the sake of cost control and minimization, a simple digital electronic control unit 190 can be used. Alternatively, a programmable logic controller (PLC) could be used as the digital electronic control unit 190; however, PLC's are typically more sophisticated and expensive than what is essentially required as a control unit 190 for the present invention.

It is also envisioned that the control unit 190 could be a fluidic type control unit, such that fluidic control of the fluid control valve 170 could be used. The fluid control valve 170 would, in such instance, need to be configured appropriately. It is further envisioned that the control unit 190 could be an analog electronic control unit 190, and that analog electric control of the fluidic control valve 170 could be used. The fluid control valve 170 would, in such instance, need to be configured appropriately.

The control unit 190 and the hydraulic control valve 170 together meter the flow of the hydraulic fluid 181 to both the first hydraulic input 164*a* and the second hydraulic input 164*b* of the reciprocating hydraulically-powered actuator 160. More specifically, in the exemplary embodiment, the control unit 190 and the hydraulic control valve 170 together meter the flow of the hydraulic fluid 181 at variable hydraulic fluid pressures or at variable hydraulic fluid flow rates to both the first hydraulic input 164*a* and the second hydraulic input 164*b* of the linear reciprocating hydraulically-powered actuator 160. Accordingly, precise control of the hydraulic control valve 170, and therefore precise control of hydraulic fluid pressures fed to the first hydraulic input 164*a* and the second hydraulic input 164*b* of the reciprocating fluidically powered actuator 160 can be achieved. It has been found that it is advantageous to have the variable hydraulic fluid pressures or the variable hydraulic fluid flow rates correspond to a sinusoidal wave over time, although square wave forms, saw tooth wave forms etc. also have utility in various applications.

It has further been found that control of the reciprocating fluidically powered actuator 160 can be achieved by simply controlling the amplitude and frequency of the hydraulic fluid pressure from the first hydraulic output 174*a* and the second hydraulic output 174*b* of the idle control valve 170, and therefore the amplitude and frequency of the hydraulic fluid pressure at the first hydraulic input 164*a* and the second hydraulic input 164*b* of the reciprocating fluidically powered actuator 160.

The fluidically powered linear motion mixer 100 for mixing liquids further comprises a feedback sensor, as indicated by the general reference numeral 165, that is operatively mounted to be responsive to the vertical position of the drive shaft 162, and/or the mixing shaft 140, and/or the mixing head 144, at positions of the upward and downward portions of the motion cycle. More specifically, the feedback sensor 165 is responsive to the vertical displacement of the drive shaft 162 and, in the exemplary embodiment, may comprise a vertically disposed linear temposonic transducer 166 and a magnet apparatus, as indicated by general reference numeral 168. The vertically disposed linear temposonic transducer 166 is mounted to the mounting table 106 by a transducer base 167*a* and a mounting bracket 167*b*. The magnet apparatus 168 comprises a ring-shaped magnet 169*a* mounted on a horizontal bar 169*b* so as to encircle the linear temposonic transducer 166, and which is securely connected to the drive shaft 162 via the horizontal bar 169*b* for coincident vertical movement therewith.

The feedback sensor 165, specifically the linear temposonic transducer 166, is connected in data transmitting relation to the control unit 190 to provide operational vertical position data to the control unit 190. In the exemplary embodiment, the linear temposonic transducer 166 of the feedback sensor 165 is connected in data transmitting relation to the control unit 190 to provide operational vertical position data to the control unit 190 in real time to provide quick response time to any feedback from the feedback sensor 165.

In the first exemplary embodiment illustrated in FIGS. 1-7, the actual vertical position data of the drive shaft 162 are compared to reference vertical position data, and the variable hydraulic fluid pressures or alternatively the variable hydraulic fluid flow rates are metered corresponding to operational vertical position data and the known vertical position data. Further, the control unit 190 calculates power consumption according to the actual vertical position data.

In use, the hydraulic pump 180 and the hydraulic control valve 170 operate under the control of the control unit 190 to provide for (a) a downward motion cycle portion and (b) an upward motion cycle portion. The downward motion cycle portion has a greater hydraulic fluid pressure at the first hydraulic output 174*a* thereof and at the first hydraulic input 16*a* of the reciprocating hydraulically-powered actuator 160, and a lesser hydraulic fluid pressure at the second hydraulic output 174*b* thereof and at the second hydraulic input 164*b* of the reciprocating hydraulically-powered actuator 160, so as to cause corresponding downward displacement of the drive shaft 162 of the reciprocating hydraulically-powered actuator 160. Conversely, the upward motion cycle portion has a lesser hydraulic fluid pressure at the first hydraulic output thereof 174*a* and at the first hydraulic input 164*a* of the reciprocating hydraulically-powered actuator 164, and a greater hydraulic fluid pressure at the second hydraulic output 174*b* thereof and at the second hydraulic input 164*b* of the reciprocating hydraulically-powered actuator 160, so as to cause corresponding upward displacement of the drive shaft 162 of the reciprocating hydraulically-powered actuator 160. The downward motion cycle portion and the upward motion cycle portion together thereby impart the vertically reciprocating movement to the mixing shaft 140 and the attached mixing head 144.

Reference will now be made to FIGS. 8 and 9, which illustrate a second exemplary embodiment fluidically powered linear motion mixer 200 according to the present invention. The second exemplary embodiment fluidically powered linear motion mixer 200 is similar in a structural sense, and fundamentally the same in a functional and operational sense to the first exemplary embodiment fluidically powered linear motion mixer 200. As such, the parts and features of the second exemplary embodiment fluidically powered linear motion mixer 200 that are substantially similar or analogous to the first embodiment of fluidically powered linear motion mixer 100 will not be discussed in detail. Further, in the second exemplary embodiment fluidically powered linear motion mixer 200, where the parts or overall structures are substantially similar or analogous to their counterparts in the first illustrated embodiment, the reference numbers used have been incremented by "100" over the reference numbers used in the first exemplary embodiment fluidically powered linear motion mixer 100, so as to be in the 200's. For example, in the second exemplary embodiment fluidically powered linear motion mixer 200, the reciprocating fluidically powered actuator is indicated by the reference numeral 260, while in the first exemplary embodiment fluidically powered linear motion mixer 100, the reciprocating fluidically powered actuator is indicated by the reference numeral 160. Revised reference numbers have been used, where necessary.

It will be appreciated that in most, but not all, mixing applications the fluidically powered linear motion linear motion mixer 100 shown in FIG. 1 will be mounted atop the central area of the cover portion 104*r* of the vessel 104. This is to promote substantially even mixing of the fluids contained within the vessel. However, it will also be appreciated that such a linear motion mixer is designed for use with a very large vessel, such as a municipal sewage digester (which typically can have a diameter of 30 metres or more), may weigh 2,500 kilograms, or more. This represents a significant additional weight to be carried by the central area of the cover portion of the vessel, particularly where such cover portion was not originally designed to accommodate such central area loading. This is often the case with vessels originally designed to utilize a plurality of rotary mixers arranged adjacent to the outside periphery of the vessel. In such retrofit situations, the central area of the cover portion of the vessel may not be sufficiently robust to safely accommodate central mounting of a fluidically powered linear motion mixer as described hereinabove. Accordingly, the second embodiment of the present invention illustrated in FIGS. 8 and 9 has been developed to address this problem by providing a variant of the fluidically powered linear motion mixer described with reference to FIGS. 1-7, which variant accommodates the re-positioning of a plurality of the mixer's components away from the central area of the cover portion of the mixing vessel, thereby transferring a significant portion of the total weight of the mixing assembly outside of the relatively weak central area of the cover portion. Thus, it will be understood that the primary difference between the first embodiment of fluidically powered linear motion mixer 100 and the second exemplary embodiment of fluidically powered linear motion mixer 200 relates to re-positioning certain components of the device away from the centre area of the cover portion 204*r* of the vessel 204 to reduce the effective weight being supported by the centre area.

More particularly, in the second embodiment of fluidically powered linear motion linear motion mixer 200 illustrated in FIGS. 8 and 9, the fluidic control valve 270, the fluidic pump 280, the electric motor 286, the reservoir 287 and the control unit 290 are displaced away from the central area of the cover portion 204*r* of the vessel 204, in order to avoid mounting these components on the physically weakest portion of the cover portion 204*r* of the vessel 204. Such movement of these components away from the central area of the cover portion 204*r* is made possible by extending the fluid conduits 271*a* and 271*b* an indeterminate length, both vertically and horizontally (as indicated by the break lines in FIGS. 8 and 9), so as to permit the fluidic control valve 270, the fluidic pump 280, the electric motor 286, the reservoir 287 and the control unit 290 to be located in any convenient location removed from the central area of the cover portion 204*r*.

In this manner, and as shown somewhat diagrammatically in FIGS. 8 and 9, the fluidic control valve 270, the fluidic pump 280, the electric motor 286, the reservoir 287 and the control unit 290 may be disposed, for example, adjacent the outer periphery 204*p* of the vessel 204. More specifically, the fluidic control valve 270, the fluidic pump 280, the electric motor 286, the reservoir 287 and the control unit 290 may be mounted on the cover portion 204*r* of the vessel 204 adjacent, but inside, the outer peripheral wall 204*w* of the vessel 204 in any conventional manner. Alternatively, it is also contemplated that the fluidic control valve 270, the fluidic pump 280, the electric motor 286, the reservoir 287 and the control unit 290 may alternatively be disposed beyond the outer peripheral wall 204*w* of the vessel 204, such as by attachment, or other mounting, on the outside of the outer peripheral wall 204*w* of the vessel 204 in any conventional manner. As a further alternative arrangement, these displaced components may be supported on a suitable platform, or in a suitable protective housing, or the like, on the ground adjacent the vessel 204. As yet another alternative, the fluidic control valve 270, the fluidic pump 280, the electric motor 286, the reservoir 287 and the control unit 290 may be disposed remotely (i.e., without any contact with or mounting on the vessel 204). If further required or desired, any or all of the fluidic control valve 270, the fluidic pump 280, the electric motor 286, the reservoir 287 and the control unit 290 may be housed in a separate building or other structure (not shown) for the sake of security, safety, and/or to establish a centralized control location for a plurality of reciprocating drive assemblies 250 mounted on an equal plurality of vessels 204 located in spaced proximity to said building or structure.

The first and second embodiments of the present invention as illustrated are otherwise substantially the same in all material respects, as will be readily appreciated by an average person skilled in the art.

More particularly, the fluidically powered linear motion mixer 200 comprises a mixing shaft 240 supporting a mixing head 244, and a reciprocating drive assembly, as indicated by the general reference numeral 250, and comprising a reciprocating fluidically powered actuator 260, a fluidic control valve 270, a fluidic pump 280, an electric motor 286, a reservoir 287 and a control unit 290. The second embodiment linear motion mixer 200 is similar to the first embodiment linear motion mixer 100, except that the fluidic control valve 270, the fluidic pump 280 and the control unit 290 may be mounted on the vessel outside the central area of the roof portion 204*r* adjacent to but inside the outer periphery 204*p* thereof, adjacent to but outside the outer periphery 204*p* thereof, or even remotely from the vessel 204.

The hydraulic pump 280 is mounted within a cabinet 285 (shown partially cut-away in FIGS. 8 and 9) which pump 280 has a fluidic input 282*a* and a fluidic output 282*b*, and is powered by the electric motor 286 mounted on the cabinet 285 via drive shaft 286*a*. A hydraulic fluid reservoir 287 is also mounted within the cabinet 285 and has a fluidic input 287*a* and a fluidic output 287*b*. The hydraulic pump 280 draws its hydraulic fluid 281 from the reservoir 287 via a conduit 288 connected in fluid communication to the fluidic output 287*a* of the reservoir 287 and the fluidic input 282*a* of the hydraulic pump 280. The reservoir 287 is fed from the hydraulic valve 270 through a return conduit 289 to the fluidic input 287*a* of the reservoir 287 by a return conduit 289, to thereby form a closed loop hydraulic system. A hydraulic fluid cooler 287*c* is optionally mounted on the side of the cabinet 285 and is connected in conventional fluid communication to the reservoir 287 by conduits 287*d* to provide cooling of the hydraulic fluid 281 as needed.

A fluidic control valve 270 has a fluidic input 272, a first fluidic output 274*a*, and a second fluidic output 274*b*, and a communication port 276. The fluidic input 272 is connected in fluid communication to the fluidic output 282*b* of the hydraulic pump 280 by conduit 279. The first fluidic output 274*a* is connected in fluid communication to the first fluidic input 264*a* of the reciprocating fluidically powered actuator 260 by conduit 271*a* and the second fluidic output 274*b* is connected in fluid communication to the second fluidic input 264*b* of the reciprocating fluidically powered actuator 260 by conduit 271*b*.

With particular reference to FIG. 8, the second embodiment of fluidically powered linear motion mixer 200 is shown with its fluidically powered actuator 260, mixing shaft 240 and mixing head 242 installed atop the central area of the cover portion 204*r* of vessel 204 (in this case a municipal sewage digester, shown partially cut away) in supported relation on a base plate 204*a* that is secured to the cover portion 204*r* of the vessel 204 by any suitable means.

As can readily be seen in FIGS. 8 and 9, the reciprocating fluidically powered actuator 260 comprises an upper frame block 210 and a lower frame block 212 interconnected by a cylindrical outer housing 216 having a top end 216*t* and a bottom end 216*b* which together define a substantially hollow interior 218 that houses a vertically movable piston 220.

An upper chamber 218*a* of the substantially hollow interior 218 is disposed immediately above the piston 220. Similarly, a lower chamber 218*b* of the substantially hollow interior 218 is disposed immediately below the piston 220 (see FIG. 8). The piston 218 operates in an analogous manner to the piston 118 of the first embodiment of fluidically powered linear motion mixer 100.

The fluidically powered linear motion mixer 200 preferably comprises three vertically stacked sets 205*a*, 205*b*, 205*c* each comprising three vertically oriented legs for mounting the fluidically powered linear motion mixer 200 on the base plate 204*a*. (Only two of the three vertically stacked legs of each set 205*a*, 205*b* and 205*c* are visible in FIGS. 8 and 9.)

Additionally, the fluidically powered linear motion mixer 200 further comprises the mixing shaft 240 that has an upper end 241*a* and a lower end 241*b* and defines a longitudinal axis "L" extending between the upper end 241*a* and the lower end 241*b*. The mixing shaft 240 supports the mixing head 244 adjacent its lower end 241*b* for immersion in the liquid 202 to be mixed in the vessel 204.

As can be best seen in FIG. 9, the mixing shaft 240 extends through an aperture 245*a* in a horizontally oriented leg mounting plate 245, and also extends through a linear bearing assembly 248 that comprises an upper linear bearing sub-assembly 248*a* mounted in an upper horizontal plate 249*a* and a lower linear bearing sub-assembly 248*b* mounted in a lower horizontal plate 249*b*. The upper horizontal plate 249*a* is securely mounted between the upper set of vertically oriented legs 205*a* and the middle set of vertically oriented legs 205*b*. The lower horizontal plate 249*b* is securely mounted between the middle vertically oriented set of legs 205*b* and the lower vertically oriented set of legs 205*c*. The mixing shaft 240 continues downwardly to extend through an aperture 204*b* in the base plate 204*a* to extend vertically downward therefrom to connect with the mixing head 244.

The linear bearing assembly 248 provides for stable vertical bi-directional sliding of the mixing shaft 240, as indicated by opposed arrows "C" in FIG. 8, as the drive shaft 240 moves generally vertically between its maximum raised position and its minimum lowered position.

By suitable extension of the length of the fluid conduits 271*a* and 271*b* in the second embodiment, the fluidic control valve 270, the fluidic pump 280, the electric motor 286, the reservoir 287 and the control unit 290 may be disposed outside of the central area of the cover portion 204*r*, in spaced relation from the fluidically powered actuator 260, mixing shaft 240 and mixing head 242, whose installation atop the central area of the cover portion 204*r* of vessel 204 has just been described. Such disposition of the fluidic control valve 270, the fluidic pump 280, the electric motor 286, the reservoir 287 and the control unit 290 allows for mounting of these components on the cover portion 204*r* of the vessel 204 outside of the central area of the cover portion 204*r*, but still on the cover portion 204*r*, being adjacent to, but inside the outer periphery 204*p* of the vessel 204. Alternatively, the displaced components may be mounted outside of the central area of the cover portion 204*r* and outside of the outer periphery 204*p* of the vessel 204, such as by attachment or other mounting on the outside of the outer peripheral wall 204*w* of the vessel 204 in any conventional manner, or, alternatively, on the ground adjacent the vessel 204. Alternatively, the fluidic control valve 270, the fluidic pump 280, the electric motor 286, the reservoir 287 and the control unit 290 may be disposed remotely (i.e., without any contact with or mounting on the vessel 204). If required or desired, any or all of the fluidic control valve 270, the fluidic pump 280, the electric motor 286, the reservoir 287 and the control unit 290 could be supported on the ground, preferably on a suitable platform or the like, or could be housed in a separate building or similar structure for the sake of safety and/or security, and/or to establish centralized control of a plurality of reciprocating drive assemblies 250 mounted on an equal plurality of vessels 204 located in the proximity of said building.

In any of these alternative instances, a substantial component of the weight of these displaced components is removed from direct support by the weaker central area of the cover 204*r* of vessel 204.

Other variations are within the spirit of the present invention. Thus, while the invention is susceptible to various modifications and alternative constructions without departing from the spirit of the inventions disclosed and claimed, only a limited number of embodiments or variations thereof have been illustrated or otherwise disclosed herein by way of non-limiting example. It should be understood, however, that there is no intention to limit the invention to the specific form or forms disclosed, but on the contrary, the intention is to cover all modifications, alternative constructions, and equivalents falling within the spirit and scope of the invention, as defined in the appended claims broadly construed.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. The use of any and all examples, or exemplary language (e.g., "such as", or, "for example") provided herein, is intended merely to better illuminate embodiments of the invention and does not pose a limitation on the scope of the invention unless otherwise claimed. No language in the specification should be construed as indicating any non-claimed element as essential to the practice of the invention.

Currently preferred embodiments of this invention are described herein. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

We claim:

1. A fluidically powered linear motion mixer for mixing liquids, the mixer comprising:

a mixing shaft having an upper end a lower end and defining a longitudinal axis extending therebetween, with the mixing shaft supporting a mixing head adjacent its lower end for immersion in said liquids;

a reciprocating drive assembly connectable to the mixing shaft adjacent its upper end for imparting vertically reciprocating movement to the mixing head in substantially parallel relation to said longitudinal axis, wherein, said drive assembly comprises:

a reciprocating fluidically powered actuator having a vertically reciprocating drive shaft coupled in driving relation to the mixing shaft and oriented such that said drive shaft moves generally vertically between a maximum raised position and a minimum lowered position, a first fluidic input and a second fluidic input, wherein increased fluid pressure at said first fluidic input causes the drive shaft to move vertically downwardly and increased fluid pressure at said second fluidic input causes the drive shaft to move vertically upwardly;

a fluidic control valve having a fluidic input, a first fluidic output, and a second fluidic output, and a communication port, said first fluidic output being connected in fluid communication to the first fluidic input of the reciprocating fluidically powered actuator and the second fluidic output being connected in fluid communication to the second fluidic input of the reciprocating fluidically powered actuator;

a fluidic pump having a fluidic output and a control input, and being connected at the fluidic output in fluid communication to the fluidic input of the control valve such that the fluidic pump provides fluid under pressure to the reciprocating fluidically powered actuator via the fluidic control valve;

a control unit having a communication interface connected to the communication port of the fluidic control valve and to the control input of the fluidic pump for permitting operation of the mixer by a user;

wherein, in use, the fluidic pump and the fluidic control valve operate under the control of the control unit to provide for:

(a) a downward motion cycle portion having a greater fluid pressure at the first fluidic output thereof and at the first fluidic input of the reciprocating fluidically powered actuator, and a lesser fluid pressure at the second fluidic output thereof and at the second fluidic input of the reciprocating fluidically powered actuator, so as to cause corresponding downward displacement of the drive shaft of the reciprocating fluidically powered actuator; and, (b) an upward motion cycle portion having a lesser fluid pressure at the first fluidic output thereof and at the first fluidic input of the reciprocating fluidically powered actuator, and a greater fluid pressure at the second fluidic output thereof and at the second fluidic input of the reciprocating fluidically powered actuator, so as to cause corresponding upward displacement of the drive shaft of the reciprocating fluidically powered actuator;

to thereby impart said vertically reciprocating movement to the mixing head.

2. The fluidically powered linear motion mixer according to claim 1, wherein the reciprocating fluidically powered actuator comprises a hydraulically-powered actuator, the first fluidic input comprises a first hydraulic input, the second fluidic input comprises a second hydraulic input, and increased hydraulic pressure at the first hydraulic input causes the drive shaft to move vertically downwardly and increased hydraulic pressure at the second hydraulic input causes the drive shaft to move vertically upwardly; wherein the fluidic control valve comprises a hydraulic control valve, the fluidic input comprises a hydraulic input, the first fluidic output comprises a first hydraulic output, and the second fluidic output comprises a second hydraulic output, the first hydraulic output being connected in fluid communication to the first hydraulic input of the reciprocating hydraulically-powered actuator and the second hydraulic output being connected in fluid communication to the second hydraulic input of the reciprocating hydraulically-powered actuator; and wherein the fluidic pump comprises a hydraulic pump and the fluidic output comprises a hydraulic output, the hydraulic output being connected at the hydraulic output in fluid communication to the hydraulic input of the control valve such that the hydraulic pump provides hydraulic fluid under pressure to the reciprocating hydraulically-powered actuator via the hydraulic control valve.

3. The fluidically powered linear motion mixer according to claim 2, wherein the control unit and the hydraulic control valve together meter the flow of the hydraulic fluid to both the first hydraulic input and the second hydraulic input of the reciprocating hydraulically-powered actuator.

4. The fluidically powered linear motion mixer according to claim 3, wherein the control unit and the hydraulic control valve together meter the flow of the hydraulic fluid at variable hydraulic fluid pressures to both the first hydraulic input and the second hydraulic input of the linear reciprocating hydraulically-powered actuator.

5. The fluidically powered linear motion mixer according to claim 4, wherein the variable hydraulic fluid pressures correspond to a sinusoidal wave over time.

6. The fluidically powered linear motion mixer according to claim 3, wherein the control unit and the hydraulic control valve together meter the flow of the hydraulic fluid at variable hydraulic fluid flow rates to both the first hydraulic input and the second hydraulic input of the linear reciprocating hydraulically-powered actuator.

7. The fluidically powered linear motion mixer according to claim 6, wherein the variable hydraulic fluid flow rates correspond to a sinusoidal wave over time.

8. The fluidically powered linear motion mixer according to claim 1, further comprising a feedback sensor operatively mounted to be responsive to the vertical position of the drive shaft and/or the mixing shaft and/or the mixing head at positions of the upward and downward motion cycle portions, the feedback sensor being connected in data transmitting relation to the control unit to provide operational vertical position data to the control unit.

9. The fluidically powered linear motion mixer according to claim 8, wherein the feedback sensor is connected in data transmitting relation to said control unit to provide operational vertical position data to the control unit in real time.

10. The fluidically powered linear motion mixer according to claim 8, wherein the feedback sensor is responsive to the vertical displacement of the drive shaft.

11. The fluidically powered linear motion mixer according to claim 8, wherein the feedback sensor comprises a linear temposonic transducer and magnet apparatus.

12. The fluidically powered linear motion mixer according to claim 8, wherein the actual vertical position data of the drive shaft are compared to reference vertical position data, and the specific hydraulic fluid pressures are metered corresponding to operational vertical position data and the known vertical position data.

13. The fluidically powered linear motion mixer according to claim 1, wherein the control unit comprises a digital electronic control unit.

14. The fluidically powered linear motion mixer according to claim 13, wherein the digital electronic control unit has a user interface for permitting control of the mixer by a user.

15. The fluidically powered linear motion mixer according to claim 13, wherein the control unit calculates power consumption according to the actual vertical position data.

16. The fluidically powered linear motion mixer according to claim 13, wherein the reciprocating fluidically powered actuator is a linear motion reciprocating fluidically powered actuator.

17. The fluidically powered linear motion mixer according to claim 1, wherein the mixing shaft is connected to the drive shaft through a cylinder rod end alignment coupler (CREAC) interposed between the drive shaft and the upper end of the mixing shaft.

18. The fluidically powered linear motion mixer according to claim 2, wherein the control unit comprises a digital electronic control unit and the communication interface of the control unit comprises a data interface, and the communication port of the hydraulic control valve comprises an electronic communication port.

19. The fluidically powered linear motion mixer according to any one of claim 1, further comprising a plurality of vertically oriented legs for mounting the fluidically powered mixer on a mounting table.

20. The fluidically powered linear motion mixer according to claim 19, further comprising a plurality of stop members secured to the mounting table and disposed under the reciprocating fluidically powered actuator for providing a lower vertical stop for the vertically reciprocating drive shaft of the fluidically powered actuator.

* * * * *